United States Patent [19]

Alderson

[11] Patent Number: 4,989,296

[45] Date of Patent: Feb. 5, 1991

[54] ADJUSTABLE BRACKET FOR SLIDING DOORS

[75] Inventor: Walter G. Alderson, Sydney, Australia

[73] Assignee: Clive Investments Pty. Limited, New South Wales, Australia

[21] Appl. No.: 412,484

[22] Filed: Sep. 26, 1989

[30] Foreign Application Priority Data

Oct. 6, 1988 [AU] Australia ..... 23499/88

[51] Int. Cl.[5] ..... A47H 15/00; E05D 15/06

[52] U.S. Cl. ..... 16/105; 16/99

[58] Field of Search ..... 16/99, 105

[56] References Cited

U.S. PATENT DOCUMENTS

| | | | |
|---|---|---|---|
| 658,515 | 9/1900 | Sheridan | 16/99 |
| 3,339,223 | 9/1967 | Laby | 16/105 |

FOREIGN PATENT DOCUMENTS

| | | | |
|---|---|---|---|
| 164750 | 5/1954 | Australia | 16/105 |
| 526795 | 6/1956 | Canada | 16/105 |
| 639745 | 4/1962 | Canada | 16/105 |

*Primary Examiner*—Richard K. Seidel
*Assistant Examiner*—Carmine Cuda
*Attorney, Agent, or Firm*—Beveridge, DeGrandi & Weilacher

[57] ABSTRACT

An adjustable support bracket is disclosed, suitable for use with sliding doors to adjust the spacing between the door and the support roller. The bracket includes a frame having an elongate slot. An adjusting lever is pivotably connected to the frame and extends across the slot. The support roller is rotatably mounted to an axle which extends through both the slot and the lever so as to be movable by the lever along the slot. Securing devices are provided for selectively securing the lever in pre-selected locations with respect to the frame.

10 Claims, 2 Drawing Sheets

ADJUSTABLE BRACKET FOR SLIDING DOORS

The present invention relates to support brackets for sliding doors and in particular to adjustable support brackets.

The invention has been developed primarily for use with sliding doors and will be described hereinafter with reference to this application. However, it will be appreciated that the invention is not limited to this particular field of use.

In the past, the adjustment of sliding door support brackets has proven difficult because of limited access to the brackets following installation. Furthermore, previously known adjustable brackets have relied upon a nut to bring two relatively slidable elements into secure frictional engagement. However, this adjustment is imprecise and difficult to effect, because of the tendency of the two elements to move relative to one another whilst the nut is being tightened.

It is an object of the present invention to provide an adjustable support bracket for sliding doors which overcomes or substantially ameliorates these disadvantages.

According to the invention there is provided an adjustable support bracket for sliding doors including a frame having an elongate slot, an adjusting lever pivotably connected to said frame and extending across said slot, a support roller rotatably mounted to an axle extending through said slot and said lever so as to be movable by said lever along said slot, and means for selectively securing said lever in preselected locations with respect to said frame.

Preferably the means for selectively securing the lever includes a plurality of locating elements on the frame cooperatively engageable with a tab on the adjusting lever.

Preferably the tab is retained in secure engagement with the locating elements by a threaded nut.

A preferred embodiment of the invention will now be described, by way of example only, with reference to the accompanying drawings in which.

Figure 1:
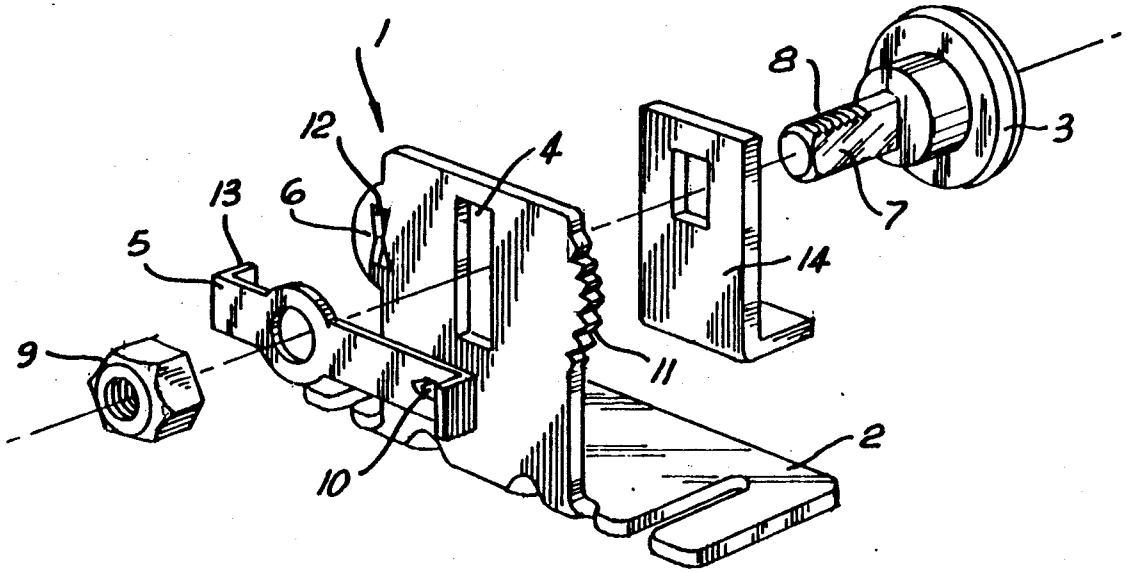
FIG. 1 is an exploded perspective view of an adjustable support bracket for sliding doors according to the invention.
Figure 2:
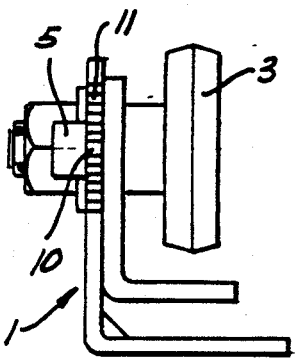
FIG. 2 is a side elevation of the support bracket.
Figure 3:
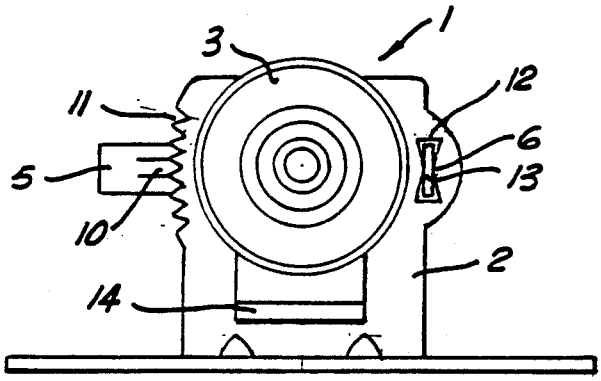
FIG. 3 is a front elevation of the support bracket.
Figure 4:
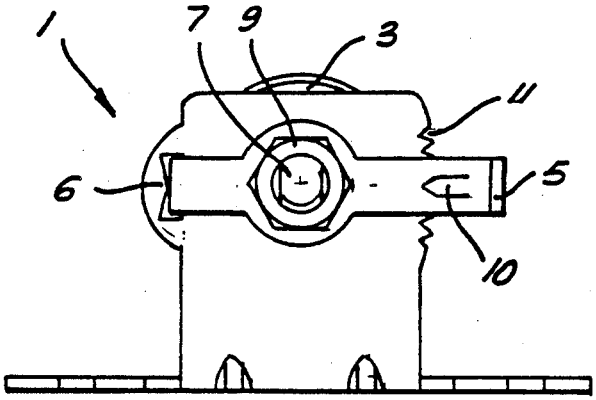
FIG. 4 is a rear elevation of the support bracket.

Referring to the drawings, the adjustable support bracket 1 includes a frame 2 adapted for mounting to a door. The frame carries a support roller 3 for engaging the sliding door track (not shown).

The frame 2 has an elongate slot 4 and an adjusting lever 5 is pivotably connected to the frame 2 at a pivot point 6 so as to extend across the slot 4. The support roller 3 is rotatably mounted to an axle 7 which extends through the slot 4 and the lever 5 so as to be movable by the lever along the slot. The axle 7 has a thread 8 engageable with a nut 9 for securing the lever and support roller to the frame.

The lever has a tab 10 selectively engaqeable with any one of a plurality of teeth 11 on the frame, such that by loosening the nut 9 the lever and thereby the support roller can be selectively adjusted to any desired location with respect to the frame. The nut 9 is then tightened to secure the lever in the preselected location.

The pivot point 6 is preferably defined by a second slot 12 which is engageable with a projecting tongue 13 on the lever. The slot 12 has a relatively narrow waist portion with wider ends to permit both accurate location and free movement of the lever.

A guide member 14 may be provided to prevent disengagement of the support roller 3 from the sliding door track.

It will be appreciated that although specific reference has been made to a plurality of teeth engageable with a corresponding tab on the lever, other locating means such as a plurality of holes could be used. Furthermore, the plurality of locating elements need not be integral with the frame, but could be associated with the lever.

Although the invention has been described with reference to specific examples, it will be appreciated by those skilled in the art that the invention may be embodied in many other forms.

I claim:

1. An adjustable support bracket for sliding doors, comprising:
   - a frame having an elongate slot;
   - an adjusting lever pivotably connected to said frame and extending across said slot;
   - an axle extending through said slot and said lever so as to be movable by said lever along said slot and said axle having a central longitudinal axis;
   - a support roller rotatably mounted to said axle; and
   - securing means for selectively securing said lever in preselected locations with respect to said frame, and said securing means including means for varying compression of said lever against said frame such that said securing means is adapted to provide a first compression level wherein said lever is in an adjustment mode and a second higher compression level wherein said lever is secured in one of said preselected locations.

2. An apparatus as claimed in claim 1 wherein said means for varying compression includes a nut engageable with a complementary thread of said axle.

3. An apparatus as claimed in claim 2 wherein said frame and said lever are fabricated from sheet metal.

4. An apparatus as claimed in claim 2 wherein said frame has a locating formation adapted for engagement with said lever.

5. An apparatus as claimed in claim 4 wherein said locating formation comprises a plurality of teeth.

6. An apparatus as claimed in claim 1 wherein said frame and said lever are fabricated from sheet metal.

7. An apparatus as claimed in claim 1 wherein said frame has a locating formation adapted for engagement with said lever.

8. An apparatus as claimed in claim 7 wherein said frame and said lever are fabricated from sheet metal.

9. An apparatus as claimed in claim 7 wherein said locating formation comprises a plurality of teeth.

10. An apparatus as claimed in claim 9, wherein said frame and said lever are fabricated from sheet metal.

* * * * *